US005813431A

United States Patent [19]

Cool et al.

[11] Patent Number: 5,813,431

[45] Date of Patent: Sep. 29, 1998

[54] SHOWER MOUNTING PLATE

[75] Inventors: Lonnie F. Cool, North Olmsted; Robert G. Schmedding, Strongsville, both of Ohio

[73] Assignee: Moen Incorporated, North Olmsted, Ohio

[21] Appl. No.: 995,628

[22] Filed: Dec. 22, 1997

[51] Int. Cl.[6] ..... F16L 5/00

[52] U.S. Cl. ..... 137/360; 137/359; 137/801

[58] Field of Search ..... 137/359, 360, 137/801

[56] References Cited

U.S. PATENT DOCUMENTS

| | | | |
|---|---|---|---|
| 1,930,314 | 10/1933 | Healy et al. . | |
| 2,747,604 | 5/1956 | Fraser | 137/360 |
| 3,443,266 | 5/1969 | Mongerson et al. | 137/359 |
| 5,031,658 | 7/1991 | Brattoli . | |
| 5,135,022 | 8/1992 | Kovey et al. . | |
| 5,277,220 | 1/1994 | Thul | 137/801 |

*Primary Examiner*—A. Michael Chambers
*Attorney, Agent, or Firm*—Dorn, McEachran, Jambor & Keating

[57] ABSTRACT

A water valve mounting assembly for use in attaching a water valve such as a shower valve to a wall of a bathroom or other type of room having washing facilities includes a valve body positioned on the exterior side of the wall in alignment with an opening in the wall. There is a mounting plate positioned on an exterior side of the wall and aligned with the valve body and wall opening, with the mounting plate being attached to the valve body and having a generally central recessed area extending toward and into the wall opening. The mounting plate has a plurality of spaced barbs adjacent its periphery, which barbs extend toward and are embedded in the exterior surface of the wall about the wall opening, with the embedded barbs preventing turning movement of the mounting plate relative to the wall and the valve body.

5 Claims, 2 Drawing Sheets

10
14
16
12
18
34
32
54
52
30
38
20
40
46
44
31
43
36
50
52
42
54
28
22
26
24

Fig. 2.
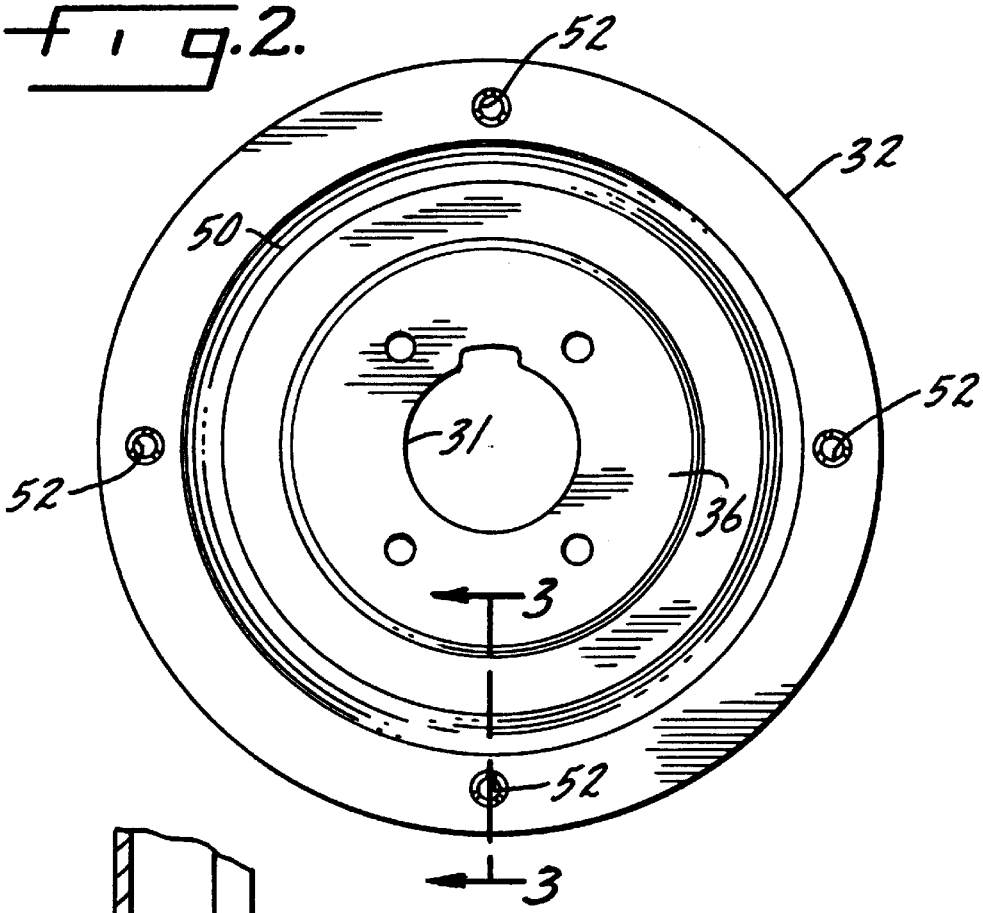
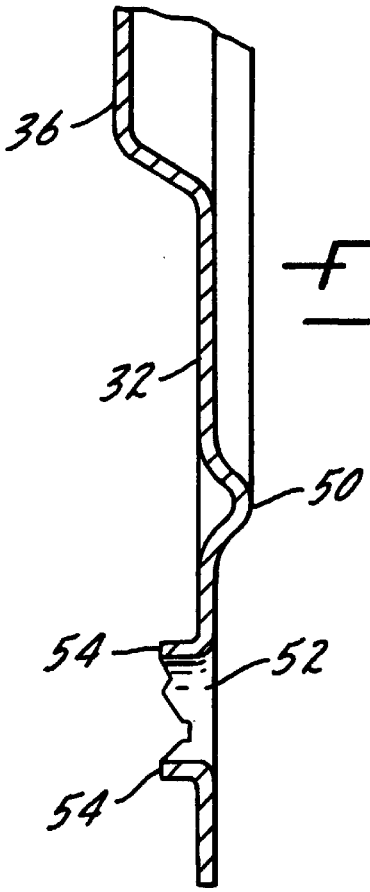
Fig. 3.

SHOWER MOUNTING PLATE

THE FIELD OF THE INVENTION

The present invention relates to a mounting assembly for shower valves which provides a strong, stable and secure attachment for a cast shower valve body to a variety of wall materials when the wall is of limited depth. Traditionally, in new construction the valve body for a shower stall will be attached to plumbing pipes prior to installation of the drywall or other wall material which will form the structural surface of a shower stall. Once the valve body has been so installed, normally there is an opening in alignment with it formed in the wall material and then the valve itself will extend from the valve body through the opening and a handle will be attached to the valve. Usually there is an escutcheon on the interior surface of the wall, which escutcheon is attached by screws to the valve body with the valve extending through the escutcheon and the handle for movement of the valve being on the outside of the escutcheon.

In the past, this type of installation has not always provided the most secure attachment of the valve body to the wall of the shower stall. The present invention provides an additional mounting plate, located on the exterior side of the shower stall wall, and attached to the valve body. Thus, the wall is clamped between the escutcheon and the mounting plate. At times, it has been noticed that the mounting plate will move or rotate after installation due to slippage between the mounting plate and the wall material. The present invention solves that problem by providing a plurality of barbs or extensions of the wall mounting plate which are embedded into the exterior side of the shower stall wall to prevent any relative movement between the mounting plate and the wall. Such barbs may be formed in a variety of ways, but the preferred form is to have a plurality of chisel-punched holes in the mounting plate which form barbs, for example, approximately 0.060" high, which are located near the outer periphery of the mounting plate and which embed themselves into the exterior side of the shower stall wall. The mounting plate may also have a reinforcing rib to provide additional structural integrity.

SUMMARY OF THE INVENTION

The present invention relates to a mounting assembly for a shower valve and in particular to a mounting plate which is attached to the exterior of the shower stall wall in a manner to prevent relative movement between the plate and the wall.

A primary purpose of the invention is to provide a strong, stable and secure mounting for a cast shower valve which may be installed on a variety of wall materials and in walls of limited depth.

Another purpose of the invention is to provide a mounting plate for use in the described assembly, which mounting plate has a series of peripherally spaced punched holes which create barbs which are embedded within the exterior wall of the shower stall during installation to prevent relative movement between the plate and the wall.

Other purposes will appear in the ensuing specification, drawings and claims.

BRIEF DESCRIPTION OF THE DRAWINGS

The invention is illustrated diagrammatically in the following drawings wherein:

FIG. 2 is a front view of the mounting plate; and

FIG. 3 is an enlarged section along plane 3—3 of FIG. 2.

DESCRIPTION OF THE PREFERRED EMBODIMENT

Figure 1:
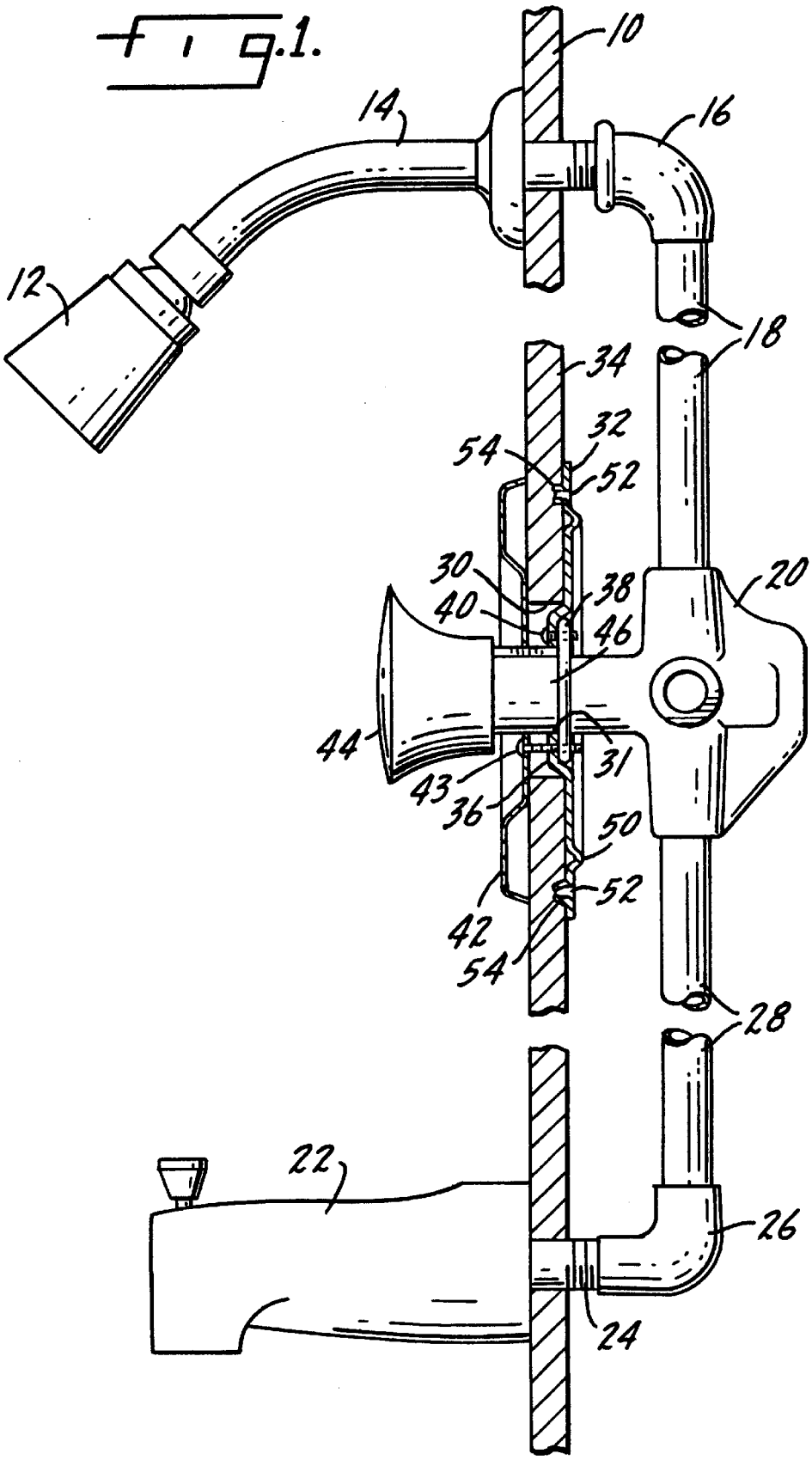
FIG. 1 is a side view of a shower/tub installation showing the mounting assembly of the present invention.

The present invention will be described in connection with a type of shower valve in which a single valve element is both rotated and reciprocated to control the volume and temperature of water discharged from the shower. Obviously, the invention should not be so limited, as it is applicable to any type of valve arrangement in which a valve body is mounted on one side of an enclosure or wall, and the control element or elements are on the opposite side. Nor should the invention be limited to shower stalls, as there are other instances in which valve bodies for washing facilities are installed on one side of a wall and the operating member or members are on the interior or room side of the wall.

A typical wall of a shower stall is indicated at 10 and it may be formed of a variety of materials. Currently shower stall walls may be formed of a special type of water resistant drywall, although obviously a variety of materials are used and will be used in the future for walls of shower stalls. The shower head is shown at 12 and is attached to a pipe 14 that extends through the wall 10 to an elbow 16. The elbow 16 is attached to a pipe 18, on the exterior side of wall 10, with the pipe 18 being attached to a valve body 20. Assuming the shower stall also has a tub water outlet, there will be a tub spout 22, which is attached to a pipe 24, which in turn is attached through an elbow 26 to a pipe 28 which again leads to the valve body 20.

The valve body 20, as well as the pipes which provide its hot and cold water inlet connections, will normally be roughed in prior to installation of the wall 10. When the wall 10 is in place, it has an opening 30 which is in alignment with the valve body. A mounting plate 32 is positioned on the exterior face 34 of the wall 10 and has a central recessed area 36 which extends into the opening 30. There is a central opening 31 in the plate 32 within the recess area 36. The valve body 20 has a flange 38 and screws 40 are used to attach the mounting plate to the flange, and thus to attach the mounting plate to the valve body.

There is an escutcheon 42 held by screws 43 which is flush against the interior side of the wall 10 and a control knob 44 will be mounted on the valve and will be positioned adjacent of the escutcheon.

Considering the use of a single lever control valve for the shower, the control valve will extend through a stop tube 46 and will be attached to the knob 44, although such valve is not shown. The stop tube will extend through the mounting plate opening 31.

The mounting plate 32 has the described central recess 36 and it may also have a peripheral circumferential strengthening rib 50 which extends away from the exterior of the wall 10, but provides structural integrity to the mounting plate.

The mounting plate has a plurality, in this case four, although the invention should not be so limited, punched holes 52. The holes may be punched by a variety of tools such as chisels, punches or the like. What is important is that the punched hole break the material of the mounting plate and form a plurality of irregularly-shaped sharp barbs 54. The barbs may have an extension of anywhere from 0.40" to 0.80" and will be embedded in the exterior surface of the wall 10. Thus, the barbs will prevent relative rotation of the mounting plate and the wall. The mounting plate cannot turn. The wall is clamped between the mounting plate and the escutcheon and the entire mounting assembly is securely attached to the wall and no part of the mounting assembly can move relative to the wall.

Whereas the preferred form of the invention has been shown and described herein, it should be realized that there may be many modifications, substitutions and alterations thereto.

The embodiments of the invention in which an exclusive property or privilege is claimed are defined as follows:

1. A water valve mounting assembly for use in attaching a water valve to a wall of a room having washing facilities, said assembly including a valve body positioned on an exterior side of the wall, which wall has an opening in alignment with the valve body, a mounting plate positioned on the exterior side of the wall and aligned with the valve body and wall opening, said mounting plate being attached to said valve body and having a generally central recessed area extending toward and into the wall opening, said mounting plate having a plurality of spaced, outwardly extending barbs adjacent its periphery, said barbs extending toward and being embedded in the exterior surface of the wall peripherally about the wall opening, said embedded barbs preventing turning movement of the mounting plate relative to the wall.

2. The mounting assembly of claim 1 wherein said barbs are formed by holes punched in the mounting plate, with the barbs being irregular in form and length.

3. The mounting assembly of claim 2 wherein said mounting plate includes a strengthening peripheral rib extending about the circumference thereof radially outside of said punched holes.

4. The mounting assembly of claim 1 further including an escutcheon positioned on the interior side of said wall, aligned with said wall opening and attached to said valve body.

5. The mounting assembly of claim 1 wherein said valve body is for a shower control valve and the wall is for a shower stall.

* * * * *